US005732772A

United States Patent [19]

Borak, Jr. et al.

[11] Patent Number: 5,732,772

[45] Date of Patent: Mar. 31, 1998

[54] DUAL SPLIT TUBING HANGER

[75] Inventors: Eugene A. Borak, Jr.; Charles D. Bridges, both of Cypress, Tex.

[73] Assignee: ABB Vetco Gray Inc., Houston, Tex.

[21] Appl. No.: 582,051

[22] Filed: Dec. 19, 1995

[51] Int. Cl.[6] ..... E21B 33/03

[52] U.S. Cl. ..... 166/75.14; 166/97.5; 166/89.2; 277/188 A

[58] Field of Search ..... 166/89.2, 84.1, 166/75.14, 97.5, 179, 189, 1; 285/137.2; 277/188 A

[56] References Cited

U.S. PATENT DOCUMENTS

| | | | |
|---|---|---|---|
| 2,794,505 | 6/1957 | Allen | 166/97.5 |
| 2,800,242 | 7/1957 | Sauthoff | 285/137.2 X |
| 3,025,083 | 3/1962 | Lebeaux | 285/137.2 X |
| 3,177,013 | 4/1965 | Rector | 285/137.2 |
| 3,881,755 | 5/1975 | Brutano | 285/137.2 |
| 4,040,636 | 8/1977 | Albertson et al. | 277/188 A |
| 4,102,632 | 7/1978 | Hastings | 285/137.2 X |

*Primary Examiner*—Hoang C. Dang
*Attorney, Agent, or Firm*—James E. Bradley

[57] ABSTRACT

A split tubing hanger for a well has two semi-cylindrical tubing hanger bodies. A seal has a ring portion which seals the tubing hanger bodies to the bore of a tubing head. The seal also has a diametrical band portion which joins the ring portion. The band portion seals between the two tubing hanger bodies. The bodies are run separately and land on a landing shoulder in the bore of the tubing head. The landing shoulder has upward extending tabs which engage recesses in the load shoulders of the tubing hanger bodies. The landing shoulder is a landing ring which is split and locates within a groove formed in the bore of the tubing head. An anti-rotation device prevents the landing ring from rotating relative to the tubing head.

9 Claims, 5 Drawing Sheets

DUAL SPLIT TUBING HANGER

BACKGROUND OF THE INVENTION

1. Field of the Invention

This invention relates in general to tubing hangers for oil and gas wells, and in particular to a dual split tubing hanger for supporting two strings of tubing.

2. Description of the Prior Art

In an oil or gas well, the produced fluid flows through tubing, which is a string of conduit located within casing. The tubing is supported within a tubing head at the upper end of the well by a tubing hanger. In some wells, two strings of tubing are employed, one for producing from one formation and the other for producing from another formation at a different elevation.

One type of dual string tubing hanger is a split type. Each string of tubing will be run and supported by a tubing hanger body that has a periphery in the shape of a "D". It has a semi-cylindrical exterior portion which joins a flat diametrical wall. The semi-cylindrical portion lands on a landing shoulder in the tubing head. Normally, the tubing strings will be run separately. Once installed, the two tubing hanger bodies will be in juxtaposition to each other, with the diametrical walls closely spaced from each other.

Various seals are employed to seal the split tubing hanger in the tubing head. An annular seal will extend around the periphery of the juxtaposed tubing hanger bodies, sealing the tubing hanger bodies to the tubing head. A diametrical slot is located between the bodies. In the prior art, this is handled by forcing a separate strip of rubber into the slot. In wells which undergo significant temperature changes, the thermal cycles cause the rubber strip to creep upward in the slot, resulting in leakage. Also, the rubber strip requires a high axial force to install and often is unable to meet pressure test specifications.

Another problem encountered with dual split tubing hangers occurs when landing the first string. The first tubing hanger body has substantial axial downward force on it due to the weight of the tubing. The circumferential load shoulder of the tubing body extends only 180 degrees, with the diametrical portion of the body being unsupported. This can result in the tubing hanger body tilting slightly, which magnifies misalignment of the upward extending neck of the tubing hanger body. Because of clearances between the tubing hanger bodies, the landing of the second tubing hanger body will not straighten the tilt of the first tubing hanger body.

SUMMARY OF THE INVENTION

The dual string tubing hanger of this invention is of a split type, having two separate tubing hanger bodies. The seal includes an annular ring portion integrally joined to a straight diametrical band portion. This seal is installed in the annular space and in the diametrical slot between the tubing hanger bodies. The seal preferably has an elastomeric portion with upper and lower compression rings.

The load shoulder, rather than being an integral shoulder formed in the bore of the tubing hanger, preferably comprises a load ring located within a groove in the tubing head. The load ring has at least one tab, and preferably two, spaced 180 degrees apart. The tabs extend upward from the load ring. The load shoulder of the first tubing hanger body has recesses that receive the tabs when the first tubing hanger body is installed. The tabs provide vertical support for the tubing hanger body to prevent it from tilting.

DETAILED DESCRIPTION OF THE INVENTION

Figure 1:
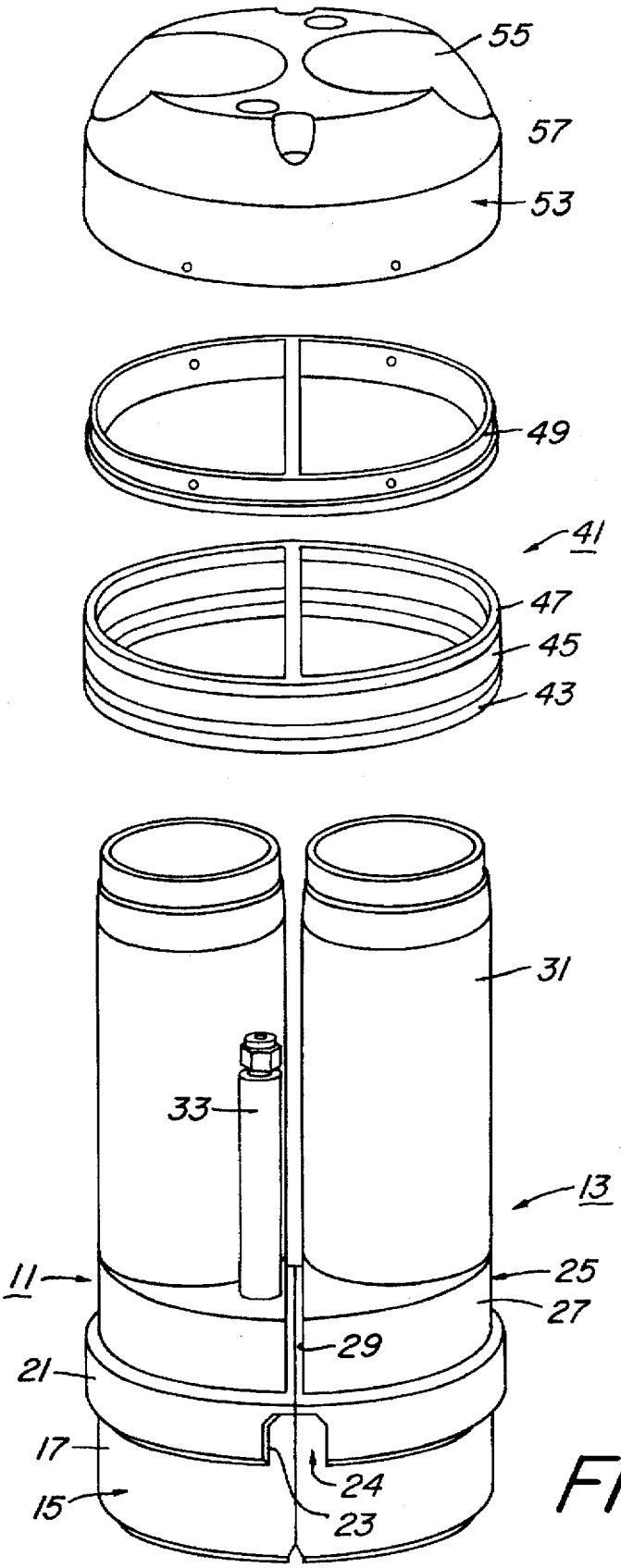
FIG. 1 is an exploded perspective view illustrating a split tubing hanger and seal constructed in accordance of this invention.

Referring to FIG. 1, the split tubing hanger includes two separate tubing hanger bodies 11, 13. Each tubing hanger body 11, 13 supports a separate string of tubing (not shown) extending into the well for producing well fluid. Each tubing hanger body has a periphery in the configuration of a "D". When installed as shown in FIG. 1, the assembly of the bodies 11, 13 provides a cylindrical split dual tubing hanger.

Each tubing hanger body 11, 13 has a lower body portion 15. Lower body portion 15 has a semi-cylindrical wall 17 which extends 180 degrees and is joined by a flat diametrical wall 19. A load shoulder 21 protrudes outward from semi-cylindrical wall 17. A recess 23 is formed in load shoulder 21 at each corner of semi-cylindrical wall 17 with diametrical wall 19. Recesses 23 are equidistant from a centerpoint of semi-cylindrical wall 17, the circumferential distance being approximately 90 degrees. Each recess 23 has an open lower end, an open side, and a closed upper end. Each recess 23 mates with an identical recess 23 on the load shoulder 21 of the adjacent tubing hanger body 11, 13 to form a dome-shaped slot 24 double in width to each individual recess 23. The open sides of mating recesses 23 join each other to form slot 24.

An upper body portion 25 extends upward from load shoulder 21. Upper body portion 25 also has a "D" shaped periphery, having a semi-cylindrical wall 27 that has the same diameter as semi-cylindrical wall 17. Load shoulder 21 protrudes outward from semi-cylindrical wall 27, as well as semi-cylindrical wall 17. Upper body portion 25 has a flat wall 29 which is offset outward from and parallel to diametrical wall 19 of lower body portion 15. Flat wall 29 is not as wide as diametrical wall 19, and unlike diametrical wall 19, is not on a true diameter line of the juxtaposed tubing hanger bodies 11, 13 because of the set back. When juxtaposed as shown in FIG. 1, the two upper portion flat walls 29 will provide a straight diametrical slot between them. The lower portion diametrical walls 19, however, will be in substantial contact with each other.

A tubular extended neck 31 extends upward from each upper body portion 25. A penetrator 33 is shown extending through tubing hanger body 11 for the passage of a line for controlling downhole equipment, such as a hydraulic line for a downhole safety valve. A similar penetrator will pass through tubing hanger body 13, but is not shown in FIG. 2.

Figure 3:
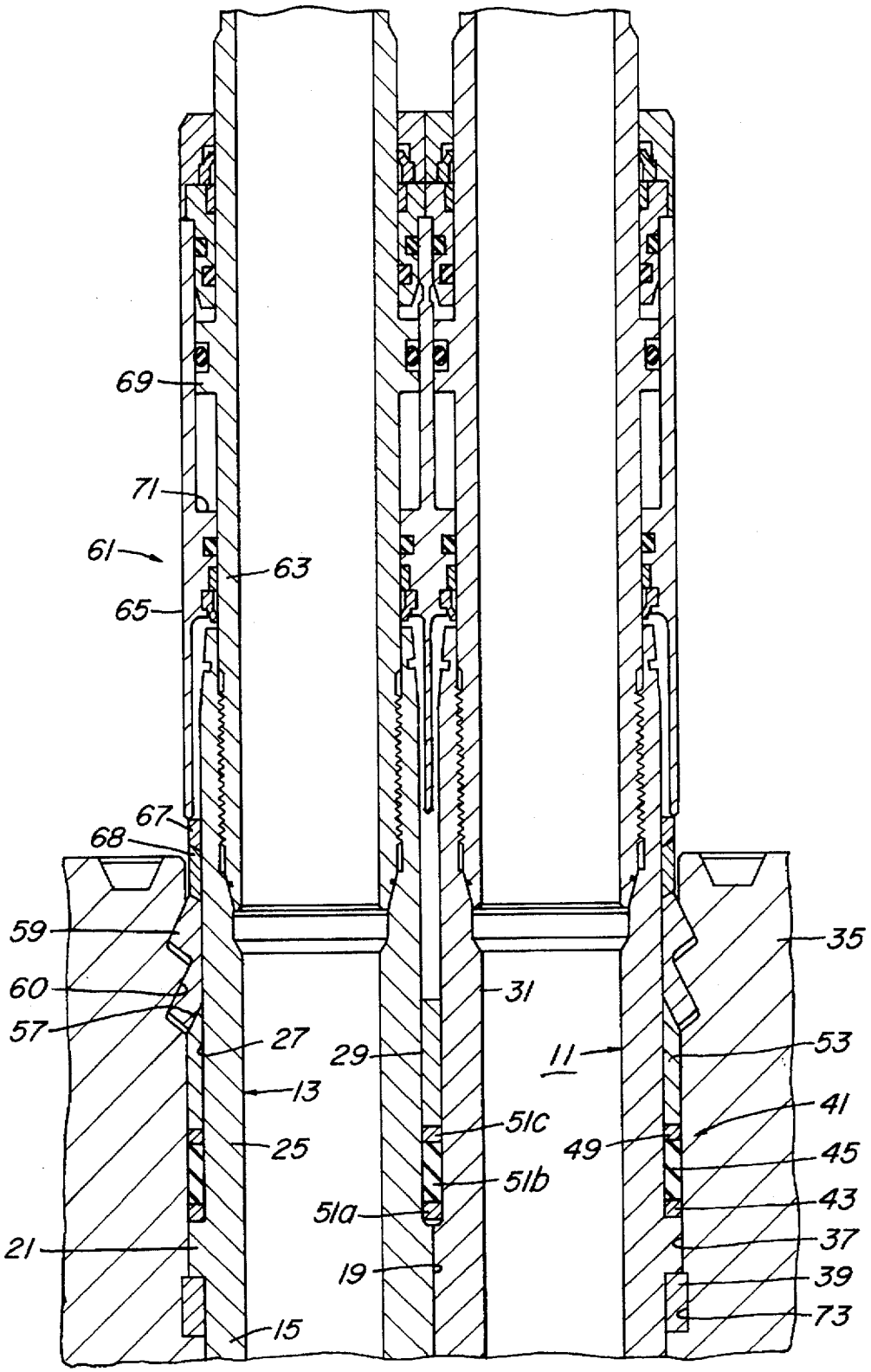
FIG. 3 is a sectional view of the split tubing hanger of FIG. 1, showing a running tool installing the seal within a tubing head.

Referring to FIG. 3, tubing hanger bodies 11, 13 are supported within a tubing head 35 which is located at the upper end of a well. Tubing head 35 is a cylindrical member having a single bore 37. A landing shoulder or ring 39 is located in bore 37, extending circumferentially around bore 37. Landing ring 39 supports the juxtaposed tubing hanger bodies 11, 13 when landed as shown in FIG. 3. Extended necks 31 protrude out the upper end of tubing head 35. Bore 37 is larger in diameter than the cylindrical periphery formed by the juxtaposed semi-cylindrical walls 27, resulting in an annular slot.

A seal 41 locates within the annular slot. Seal 41 is shown more clearly in FIG. 1 and includes a lower compression ring portion 43 of metal and a central elastomeric ring portion 45. Elastomeric ring portion 45 preferably has anti-extrusion wire mesh layers 47 on the upper and lower edges. An upper metal compression ring 49 locates on top of elastomeric ring portion 45.

Seal 41 also includes a diametrical band 51 portion which extends across and is integrally formed with ring portions 43, 45 and 49 of seal 41. Diametrical band 51 has a lower metal portion 51*a* that is joined to lower compression ring portion 43 and a central portion 51*b* that is elastomeric and joined to elastomeric ring portion 45. It has an upper portion 51*c* that is metal and integrally joined to upper compression ring portion 49. The vertical dimension of band portion 51 from the lower edge of lower metal portion 51*a* to the upper edge of upper metal portion 51*c* is the same as the vertical dimension of ring portion from the lower edge of lower compression ring 43 to upper compression ring 49. The result comprises an integral seal having two "D" shaped portions, with band 51 being on a diametrical line of elastomeric ring 45. Diametrical band portion 51 fits in the straight slot between the two flat walls 29, as shown in FIG. 3.

Referring again to FIG. 1, seal 41 is set and retained by a cap 53 which has two holes 55 for the passage of extended necks 31. Cap 53 is a cylindrical member having an upper conical shoulder 57 that faces upward and outward. Referring again to FIG. 3, cap 53 is forced downward and retained by lockdown dogs 59 which engage a recess 60 in tubing head 35. Dogs 59 are the same general type as shown in U.S. Pat. No. 5,341,885, Aug. 30, 1994.

A running tool 61 is shown in FIG. 3 for installing dogs 59. Running tool 61 has two side-by-side mandrels 63 which are secured by threads to inner threads in extended necks 31. A single cylindrical sleeve 65 extends around the mandrels 63. The lower edge of sleeve 65 engages a reaction ring 67 which in turn engages the upper ends of dogs 59. Dogs 59 are carried by a carrier ring 68. Piston bands 69, 71 are formed in mating surfaces in sleeve 65 and mandrels 63 to form a hydraulic chamber for moving sleeve 65 downward to force dogs 59 downward and set seal 41. Dogs 59 also retain the tubing hanger bodies 11, 13 against any upward movement.

Figure 4:
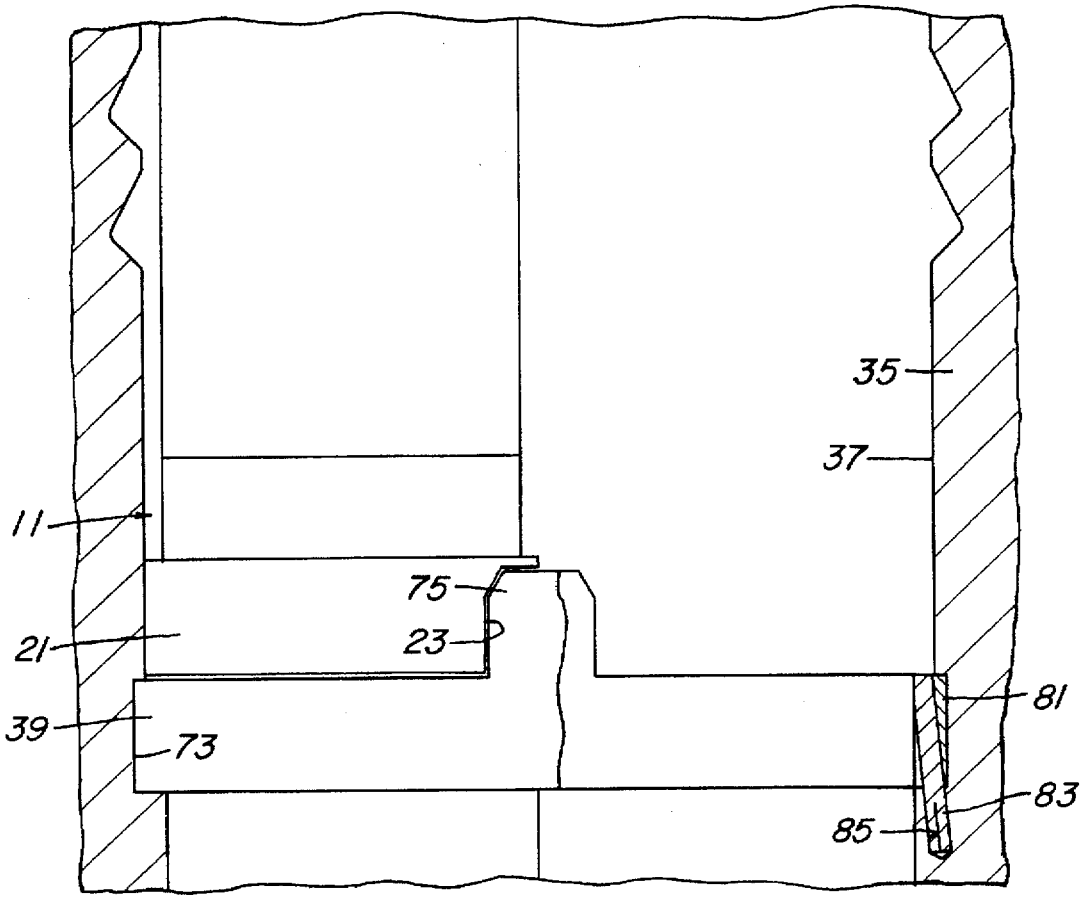
FIG. 4 is an enlarged vertical sectional view illustrating a landing ring in the tubing head which supports the split tubing hanger of FIG. 1.
Figure 5:
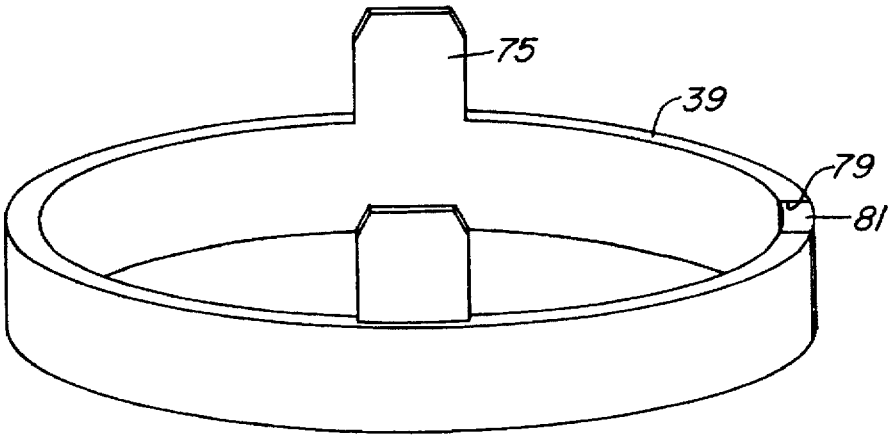
FIG. 5 is a perspective view of the landing ring shown in FIG. 4.

Referring to FIG. 4, in the preferred embodiment, landing ring 39 is located within a groove 73 formed in bore 37 of tubing head 35. Landing ring 39 has two tabs 75 extending upward, spaced 180 degrees apart. Tabs 75 have widths and heights equal to the slots 24 formed by the two recesses 23 (FIG. 1) of each of the tubing hanger bodies 11, 13. Landing ring 39 has an outer diameter that in its natural state is the inner diameter of groove 73, which is larger than the inner diameter of bore 37 immediately above and below. In order to place landing ring 39.within groove 73, two cuts 79 are made fairly close to each other, forming a separate segment or key 81. Key 81 has a pin 83 protruding downward from it that will insert into a hole 85 drilled in the base of groove 73. Ring 39 is installed in groove 73 by first removing key 81 and collapsing ring 39 to a lesser diameter than bore 37. Once located in recess 73, ring 39 is allowed to expand to it natural diameter and key 81 is installed. Pin 83 will prevent rotation of ring 39 and position tabs 75 to orient the tubing hanger bodies 11, 13 relative to tubing head 35.

Figure 2:
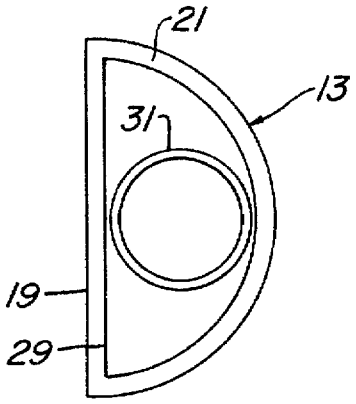
FIG. 2 is a top view of one of the tubing hanger bodies of FIG. 1.

In operation, referring to FIG. 2, first one of the tubing hanger bodies 11, 13 will be installed. For discussion purposes, assume that tubing hanger body 11 is the first to be installed. It will be secured to the upper end of a string of tubing and lowered into the well. Tubing hanger body 11 will land on landing ring 39. Recesses 23 (FIG. 1) will slide over half of each of the tabs 75 (FIG. 4) to provide support to prevent slight tilting of tubing hanger body 11.

Then the second tubing hanger body 13 will be secured to the upper end of a string of tubing and lowered into place in juxtaposition with tubing hanger body 11, as shown in FIG. 3. Its recesses 23 will slide over the other half of tabs 75. The operator will then install seal 41 within the annular space at the inner diameter of bore 37 and within the slot between flat walls 29. The operator installs hydraulic running tool 61, shown in FIG. 3. Dogs 59 are placed within the recess, and forced down by the hydraulic sleeve 65. Dogs 59 push downward on seal 41 to set it and wedge in place against tubing head bore 37 to hold seal 41 in compression. The running tool 61 is then removed, leaving carrier ring 68.

Figure 6:
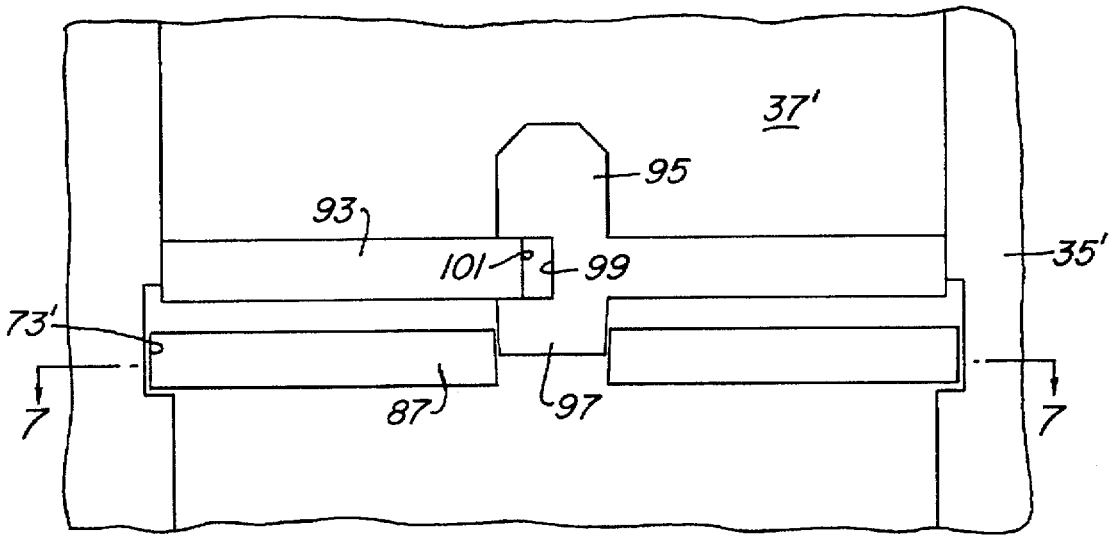
FIG. 6 is a sectional view of an alternate embodiment of a landing ring assembly being installed within a tubing head.
Figure 7:
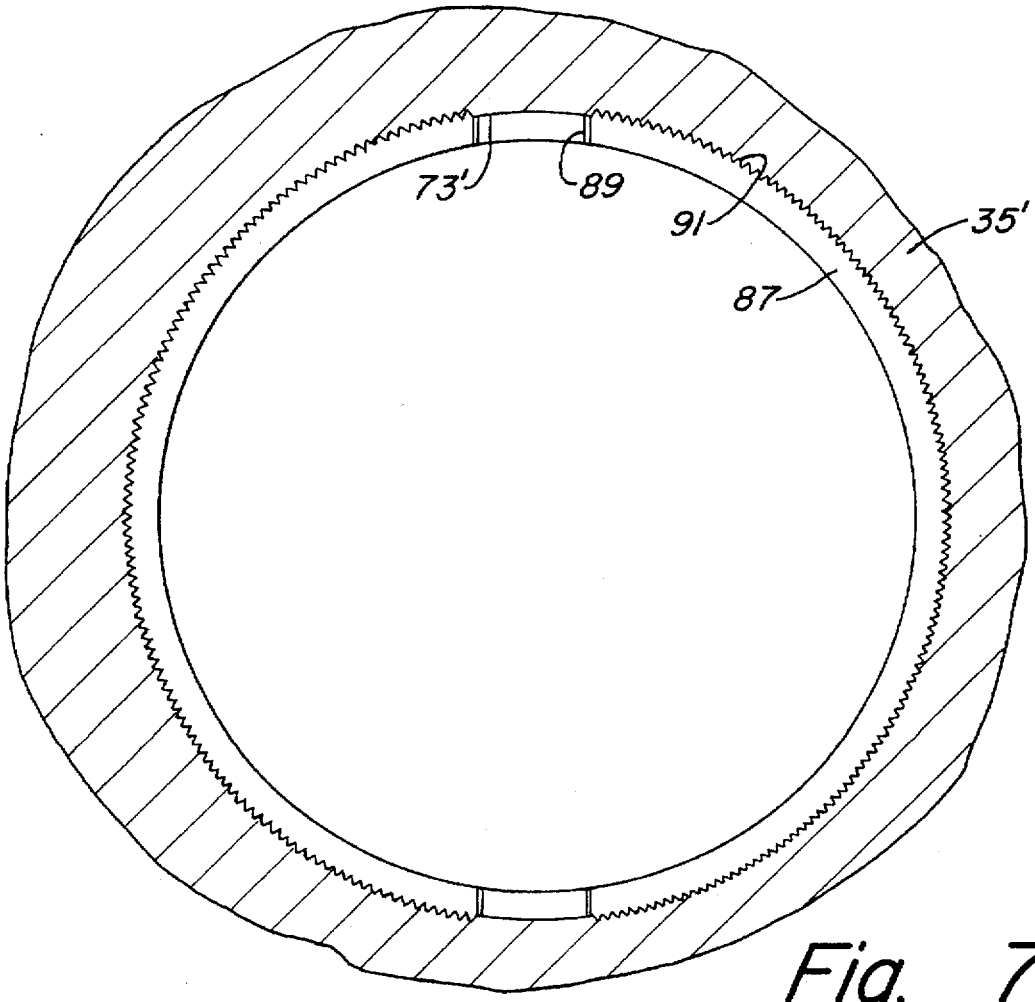
FIG. 7 is a sectional view of a lower portion of the load ring assembly of FIG. 6, taken along the line 7—7 of FIG. 6.
Figure 8:
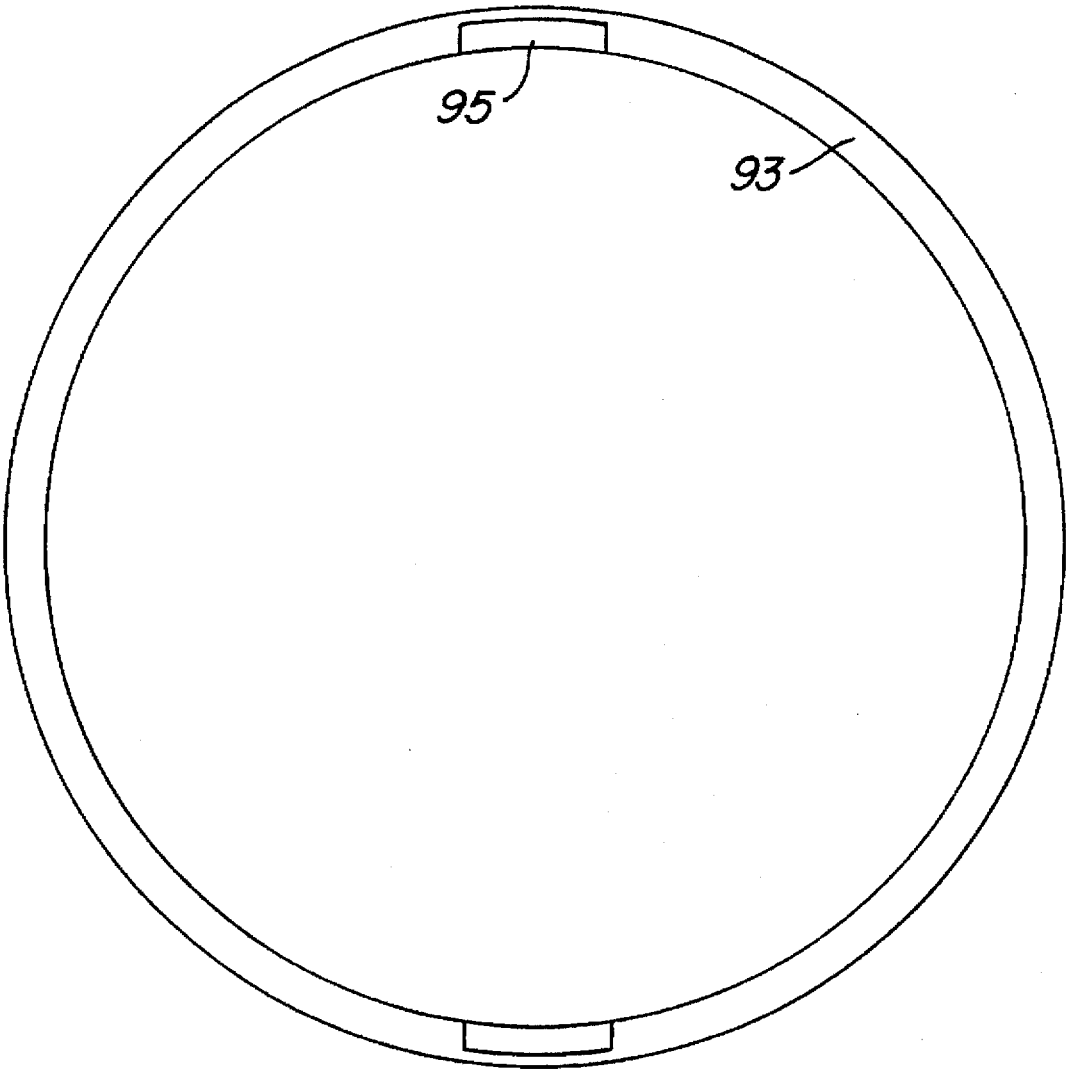
FIG. 8 is a top view of the load ring assembly of FIG. 6.

FIGS. 6–8 show an alternate embodiment of landing ring 39 In this embodiment, a lower or first ring 87 of two separate pieces or segments is first installed at the base of-groove 73'. As shown in FIG. 7, the segments of lower ring 87 are separated by two gaps 89, with the ends of each segment tapering downwardly relative to the axis of the tubing head bore 37'. Gaps 89 are located 180 degrees apart from each other. Lower ring segments 87 have knurled exteriors 91 having teeth for gripping the side wall of groove 73'.

An upper ring 93 is adapted to locate also in groove 73' on top of lower ring segments 87. Upper ring 93 has two upwardly extending tabs 95 integrally formed with it. Upper ring 93 has two lower tabs or wedges 97 extending downward directly below tabs 95. Upper ring 93 is split at tabs 95, provide a slot 99 which extends a selected circumferential distance. The free end 101 of upper ring 93 inserts within slot 99 to allow the diameter of ring 93 to be reduced to insert it through bore 37'. Once it reaches groove 73', ring 93 will expand due to its resiliency. An axial force is applied to upper ring 93 to wedge the lower wedges 97 into the gaps 89. This wedges the lower ring segments 87 tightly outward to grip tubing head 35', preventing rotation of upper ring 93. Positioning gaps 89 at the desired position will enable the desired orientation for the tubing hangers 11, 13.

The invention has significant advantages. The seal, having a diametrical band across it, more effectively seals than the prior art rubber strip. Less force is required to set the integral band than the rubber strip. Thermal cycles do not cause the band to creep upward as in the prior art rubber strip because the band is retained with the ring portion of the seal. The tabs of the landing ring provide support to one of the tubing hanger bodies before the other lands, preventing tilting.

While the invention has been shown in only two of its forms, it should be apparent to those skilled in the art that it is not so limited, but is susceptible to various changes without departing from the scope of the invention.

We claim:

1. In a dual string tubing hanger which has two separate semi-cylindrical bodies which are juxtaposed in a tubing head, each supporting a string of tubing, the bodies having upper portions separated from each other by a diametrical slot and spaced from the tubing head by an annular space, and improved seal comprising:

an annular ring portion which locates within the annular space;

a diametrical band portion integrally joined to the ring portion which divides the ring portion into two identical semi-cylindrical portions and which locates within the slot; and wherein a portion of the ring portion and the band portion are formed of an elastomer for sealing the tubing hanger bodies to the tubing head and sealing between the bodies.

2. The tubing hanger according to claim 1, further comprising:

compression means for applying axial compression simultaneously to the ring portion and band portion, and for retaining the ring portion and band portion under compression to cause the ring portion and band portion to seal.

3. The tubing hanger according to claim 1, further comprising:

a cylindrical metal cap which fits on top of the bodies above the ring portion and band portion; and at least one lockdown member which engages the tubing head and the cap, applying and maintaining an axial downward force on the cap which transmits to the ring portion and band portion to cause the ring portion and band portion to seal.

4. The tubing hanger according to claim 1 wherein the ring portion and the band portion have vertical dimensions from a lower edge to an upper edge which are the same.

5. The tubing hanger according to claim 1 wherein the ring portion and the band portion each has a lower metal compression member and an upper metal compression member separated by a central portion, the central portion being the portion which is formed of an elastomer.

6. A wellhead comprising in combination:

a tubing head having a bore containing a landing shoulder;

two separate tubing hanger semi-cylindrical bodies which are juxtaposed in the bore of the tubing head, each having a load shoulder landed on the landing shoulder and supporting a string of tubing, the bodies having upper portions which have flat walls separated from and parallel to each other, defining a diametrical slot, the upper portions having semi-cylindrical walls which are spaced inward from the bore of the tubing head, defining an annular space;

an annular ring portion which locates within the annular space;

a diametrical band portion integrally joined to the ring portion which divides the ring portion into two identical semi-cylindrical portions and which locates within the slot;

the ring portion and the band portion each having a central elastomeric portion for sealing the tubing hanger bodies to the tubing head and sealing between the tubing hanger bodies, and metal upper and lower compression portions for transmitting compressive forces to the central elastomeric portions, the ring portion and the band portion having vertical dimensions from a lower edge of the lower compression member to an upper edge of the upper compression member that are the same;

a cylindrical metal cap which fits on top of the bodies in contact with the ring portion and band portion; and a plurality of lockdown members which engage the tubing head and the cap, applying and maintaining an axial downward force on the cap which transmits to the ring portion and band portion to cause the elastomeric portions to seal.

7. The wellhead according to claim 6, further comprising:

at least one tab extending upward from the landing shoulder in the bore; and a mating recess in the load shoulder of at least one of the bodies for receiving the tab, the recess being adjacent to a corner formed by an intersection of the flat wall with the semi-cylindrical wall, so that the tab will provide support to said one of the bodies to prevent it from tilting prior to landing of the other of the bodies.

8. A seal for a dual string tubing hanger which has two separate semi-cylindrical bodies which are juxtaposed in a tubing head, each supporting a string of tubing, the bodies having upper portions separated from each other by a diametrical slot and spaced from the tubing head by an annular space, the seal comprising:

an annular ring which is adapted to locate sealingly within the annular space;

a straight diametrical band joined to the ring which divides the ring into two identical semi-cylindrical portions and which is adapted to locate sealingly within the slot; and wherein the ring and the band each comprise a lower metal compression layer, a central elastomeric layer and an upper metal compression member.

9. The seal of claim 8 wherein the ring and the band each further comprise:

a lower wire mesh layer;

an upper wire mesh layer; and wherein the lower and upper wire mesh layers are bonded to the central elastomeric layer.

* * * * *

UNITED STATES PATENT AND TRADEMARK OFFICE

CERTIFICATE OF CORRECTION

PATENT NO. : 5,732,772

DATED : March 31, 1998

INVENTOR(S) : Eugene A. Bork, Charles D. Bridges

It is certified that error appears in the above-identified patent and that said Letters Patent is hereby corrected as shown below:

Column 4, Line 1, immediately after "39" delete ".".

Signed and Sealed this

Tenth Day of November 1998

*Attest:*

*Attesting Officer*

Bruce Lehman

BRUCE LEHMAN

*Commissioner of Patents and Trademarks*